US005172908A

United States Patent [19]

Steinhilber

[11] Patent Number: 5,172,908

[45] Date of Patent: Dec. 22, 1992

[54] SORTING DEVICE FOR STORING SHEET-FORM RECORDING MEDIA

[76] Inventor: Helmut Steinhilber, Sonnenbergstrasse 40, CH-6052 Hergiswil, Switzerland

[21] Appl. No.: 675,569

[22] Filed: Mar. 27, 1991

[30] Foreign Application Priority Data

Mar. 27, 1990 [DE] Fed. Rep. of Germany ..... 4009731

[51] Int. Cl.[5] ..... B65H 39/10

[52] U.S. Cl. ..... 271/288; 271/291; 271/296; 271/298; 271/300; 271/302

[58] Field of Search ..... 271/287, 288, 289, 291, 271/296, 298, 300, 302, 226, 253, 254; 270/58; 414/790.9, 794.4

[56] References Cited

U.S. PATENT DOCUMENTS 4,285,508 8/1981 Kaneko ..... 271/290 X
4,881,730 11/1989 Kaneko ..... 271/296
4,887,060 12/1989 Kaneko .
4,900,009 2/1990 Kitahara et al. ..... 271/296
4,913,426 4/1990 Kaneko .
5,048,819 9/1991 Kosaka et al. ..... 271/288
5,078,385 1/1992 Serita ..... 271/300 X

FOREIGN PATENT DOCUMENTS 0066453 5/1980 Japan ..... 271/296
0144052 8/1983 Japan ..... 271/287

*Primary Examiner*—Robert P. Olszewski
*Assistant Examiner*—Carol Lynn Druzbick
*Attorney, Agent, or Firm*—Mason, Fenwick & Lawrence

[57] ABSTRACT

In a sorting device for sorted storage of recording media, a transport unit (32) receives the recording media (12) and conveys them to a selected storage compartment (16). Transport unit (32) runs on an endless positioning belt (24). In transport unit (32), sheet (12) is seized and gripped by rollers (34, 36). A single motor (26) drives positioning belts (24) of transport unit (32) and a drive belt (42) for their rollers (34, 36).

24 Claims, 5 Drawing Sheets

SORTING DEVICE FOR STORING SHEET-FORM RECORDING MEDIA

The invention relates to a sorting device for storing sheet-form recording media.

A sorting device of this species is known from DE-A 36 43 340. This sorting device has a plurality of storage compartments arranged one above the other. A transport device can be moved up and down in front of these storage compartments. In a receiving position, the transport unit receives the sheet-form recording media, especially sheets of paper from an office machine, between a pair of rollers. While the recording medium is gripped between the rollers, the transport unit is moved into a dispensing position in front of a selected storage compartment. The rollers are then powered, pushing the sheet into the storage compartment.

The known sorting device requires one drive motor for positioning the transport unit and another for driving the rollers. The motor for driving the rollers is located in the transport unit and is moved together with the latter. This makes the transport unit costly and the power supply and control for the drive motor of the rollers must come through cables carried along with it.

The transport unit receives the recording medium in the position in which it is discharged from the office machine and also places it in the storage compartment in this same position. If the office machine is a printer for example which discharges the paper sheets with the printed side upward (face up), the successive printed paper sheets will be stored in the incorrect sequence. It is impossible to store them in the correct sequence with the printed side downward (face down). The sorting device has a preset number of storage compartments which are located in a preset position and have a preset receiving capacity. It is not possible to change the number of storage compartments and especially the receiving capacity of these storage compartments.

The goal of the invention is to provide a sorting device which is less costly to manufacture and is more flexible in operation.

In the sorting device according to the invention, the transport device is moved by an endlessly circulating positioning pulling means, preferably a positioning belt. The transport unit therefore always moves in the same direction on a continuous path. The recording media to be stored consequently can be optionally stored in the same position in which they are received (e.g. face up) or in the inverted position (face down). For this purpose it is merely necessary to control the sequence of functions of the sorting device in such manner that the recording media are received from the transport unit ahead of or beyond the reversal point of the continuous path.

In contrast to the prior art, in which the transport unit moves up and down, the recirculating movement of the transport unit according to the invention also permits the use of two transport units, positioned diametrally on the same positioning pulling means. When one transport unit is in the dispensing position in front of the storage compartments, the other transport unit is directly in front of the receiving position, so that immediately after a recording medium is dispensed into the storage compartments by one transport unit, the next recording medium can be received by the other transport unit. Hence, the sorting device can operate much more rapidly, which is particularly important with a large number of storage compartments and correspondingly longer transport distances of the transport unit.

The drive for the positioning pulling means for moving the transport unit and for driving the rollers of the transport unit to receive and dispense the recording media is provided by the same motor. It is merely necessary to switch the direction of rotation of the motor in order to switch between driving the positioning pulling means and driving the rollers of the transport unit. The transport unit has no separate drive motor and no cable feeds for the power supply and control of a drive motor, which reduces the cost of the sorting device and considerably simplifies its construction.

Higher flexibility of the sorting device is provided according to the invention by virtue of the fact that the storage compartments can be installed at different intervals. This makes it possible to vary the number and capacity of the storage compartments. An increase in the capacity of the storage compartments in one advantageous embodiment is accomplished by the supporting wall which holds the stack of sheets in the storage compartment having an additional sheet stop which can be moved out beyond the supporting wall in order to raise the supporting wall, so that the storage compartment can accommodate a stack of pages which grows higher than the supporting wall.

Preferably, the storage compartments are provided with a hold-down device which compresses the stack of sheet-form recording media stored in the storage compartment to ensure tight, space-saving storage. The hold-down device is advantageously raised by the transport unit off the stored stack of pages when the transport device reaches the dispensing position in front of that particular storage compartment. Consequently the hold-down device automatically opens up an insertion gap for the recording medium to be stored, without additional expensive control and actuating means being required.

In addition, a stop can be provided which limits this lifting motion of the hold-down device. When the hold-down device comes in contact with this stop, a "full" signal is generated indicating that that storage compartment is full. This "full" signal is advantageously generated by the hold-down device when it comes in contact with the stop, opposing a high resistance to the lifting motion by the transport device. This makes it possible to have a "full" message without optoelectronic scanning or microswitches being required on each individual storage compartment. The "full" signal is generated instead in the drive of the transport unit and can therefore be accommodated advantageously directly in the electronic control for the sorting device. In particular, this type of generation of a "full" signal favors random insertion of storage compartments in the sorting device and hence its flexibility.

Especially simple positioning of the transport unit and generation of the "full" signal can be accomplished by the housing of the motor driving the transport unit being rotatably mounted to oppose a spring force. When the transport unit encounters a resistance, initially when the hold-down device is lifted and then when it comes in contact with the "full" stop, the torque of the motor shaft increases abruptly and the motor housing rotates against the spring force. This causes the motor housing to actuate switching elements to generate the required signals, in other words initially to generate the start signal for the drive to the rollers of the transport unit to dispense the recording medium into the storage compartment, and then to generate the "full" signal. This keeps the cost of scanning and switching elements to a minimum.

Preferably the sorting device is designed with essentially horizontal storage compartments arranged one above the other. However it is also possible to arrange the storage compartments so that they are essentially perpendicular to one another, whereby the transport unit moves horizontally over the storage compartments and is positioned there.

The invention will now be described in greater detail with reference to an embodiment shown in the drawing.

Figure 1:
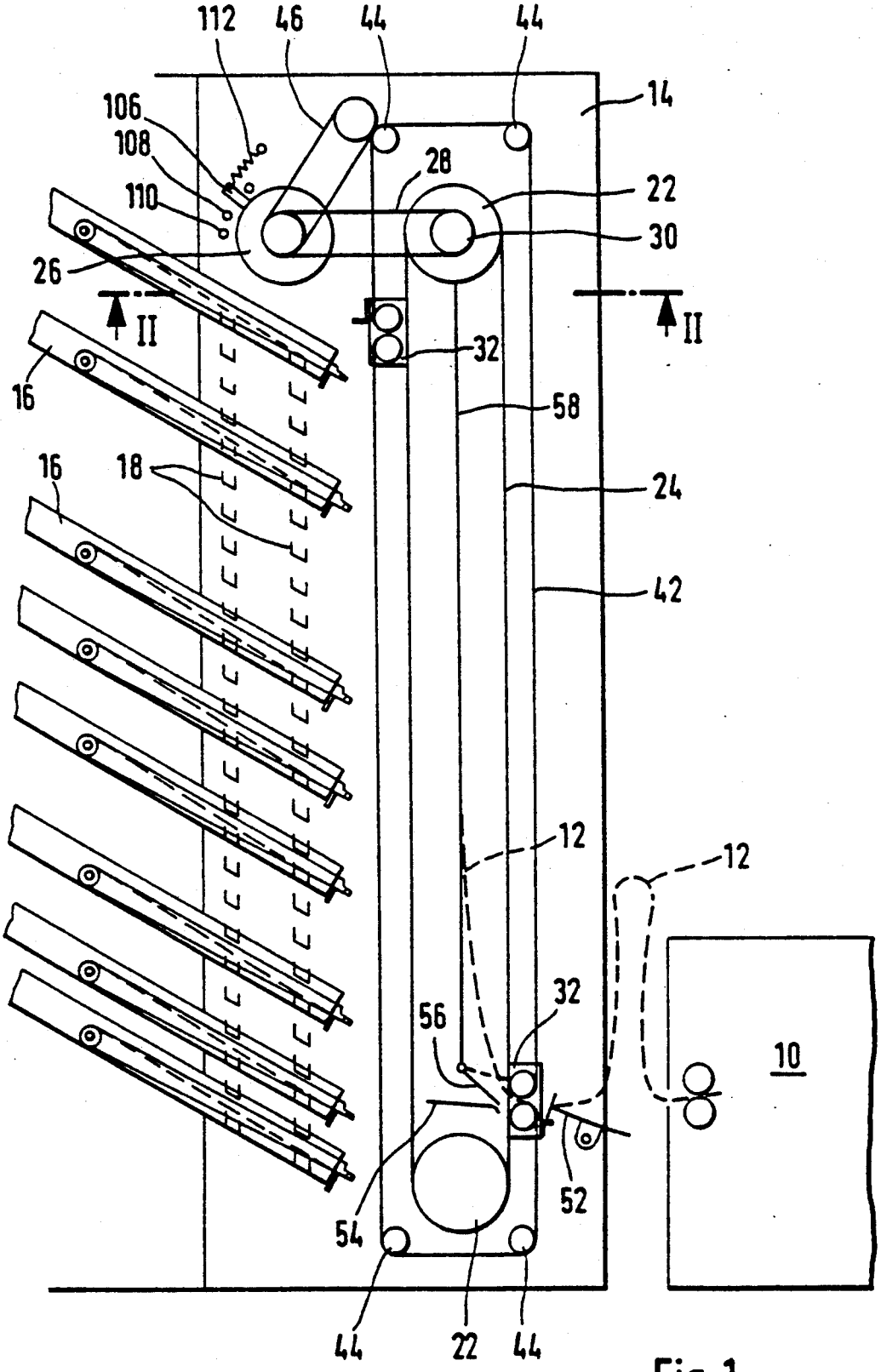
FIG. 1 is a schematic side view of the sorting device.

In FIG. 1, the sorting device is shown in conjunction with an office machine 10, for example a printer. Office machine 10 dispenses recording media in the form of printed sheets of paper 12 which must be sorted and stored. The sorting device has a housing with side walls 14 into which storage compartments 16 can be inserted one above the other inclined slightly to the horizontal. For this purpose two vertical rows of stamped and inwardly bent supporting flaps 18 are provided in side walls 14, said flaps supporting storage compartments 16. Flaps 18 in the two vertical rows are staggered heightwise with respect to one another in order to set the slope angle of storage compartments 16 relative to the horizontal. The number and mutual vertical spacing of support flaps 18 permit considerable variation in the number and arrangement of storage compartments 16. The rear ends of storage compartments 16 project from side walls 14 in order to allow the stored paper sheets to be removed from storage compartments 16.

A shaft 20 is rotatably mounted above and below between sidewalls 14. Toothed pulleys 22 are mounted on shafts 20, on both sides and nonrotationally. Endless toothed positioning belts 24 run over pulleys 22 as positioning pulling means. Upper shaft 20 is driven by an electric stepping motor 26 mounted on sidewall 14 through a toothed drive belt 28. Toothed drive belt 28 engages a toothed pulley 30 which rests on shaft 20 with an overrunning clutch. When stepping motor 26 as shown in FIG. 1 is driven clockwise, so that toothed pulley 30 rotates clockwise as well, the overrunning clutch engages and positioning belts 24 are powered to run clockwise. When stepping motor 26 is driven counterclockwise, the overrunning clutch disengages and positioning belts 24 are not driven. A pawl prevents the positioning belts from moving counterclockwise.

Two transport units 32 are fastened to the two positioning belts 24, said units extending crosswise to the direction of rotation of positioning belts 24. The two transport units 32 are arranged diametrally opposite one another on positioning belts 24 so that one transport unit 32 for example is at the bottom right when the other transport unit 32 is at the upper left, as shown in FIG. 1.

Figure 2:
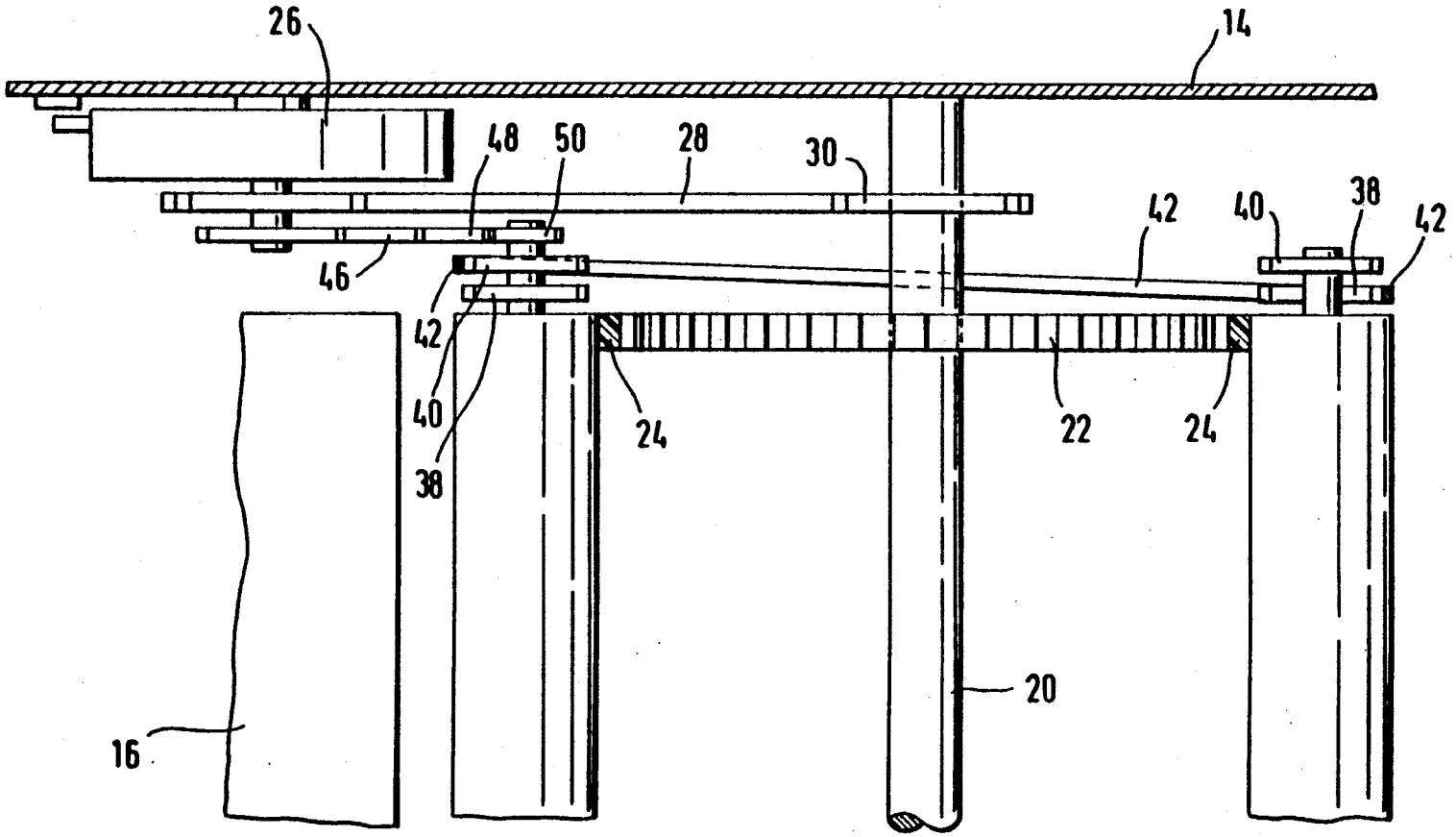
FIG. 2 is a partial view of the sorting device along line II—II in FIG. 1.

In transport units 32, two rollers 34 and 36 are rotatably mounted which extend over the entire width of transport unit 32. The shafts of the two rollers 34 and 36 run parallel to one another in a plane which is parallel to positioning belt 24. Rollers 34 and 36 have a frictional surface and are in contact with one another along a roller nip. The shafts of rollers 34 and 36 are brought out on one end laterally beyond transport unit 32 as shown in FIG. 2. On this end, the shafts each have a gear 38 or 40, with said gears 38 and 40 being staggered axially by a little more than the width with respect to one another. Gears 38 and 40 each engage through an overrunning clutch 104, the shafts of rollers 34 and 36, said clutch engaging when gears 38 and 40 rotate clockwise relative to the shaft (in FIG. 1). A driving pulling means in the form of an endlessly circulating drive belt 42 is guided over idler pulleys 44 so that it runs parallel to the vertical run of positioning belt 24 on the side of transport units 32 facing away from said run of said belt. Drive belt 42 is reversed at top and bottom above and below pulleys 22 as shown in FIG. 1. The two upper idler pulleys 44 and the two lower idler pulleys 44 are each staggered axially with respect to one another in such fashion that drive belt 42, on the side at the left in FIG. 1, engages gear 40 of roller 36, and on the right side in FIG. 1, engages gear 38 of roller 34, as shown in FIG. 2.

Drive belt 42 is also driven by stepping motor 26. Stepping motor 26 drives a gear 48 through a toothed drive belt 46, said gear in turn engaging a gear 50 which rests by means of a overrunning clutch on the shaft of one of idler pulleys 44. When stepping motor 26 is driven counterclockwise (in FIG. 1), the overrunning clutch engages and drive belt 42 is driven clockwise (in FIG. 1). When stepping motor 26 is driven clockwise, the overrunning clutch disengages and drive belt 42 is not driven.

The housing of stepping motor 26 is mounted rotatably on sidewall 14 and is held by a spring 112 with a nose 106 projecting radially in the clockwise direction (in FIG. 1) against a stop on sidewall 14. When the housing rotates against the force of spring 112, nose 106 actuates sequentially two switching elements 108 and 110 staggered at an angle with respect to one another, said switching elements being proximity switches for example.

Opposite the sheet discharge of office machine 10, immediately in front of the path of movement of transport unit 32, a pivotable sheet stop 52 is provided in the sorting device. In addition, at this level inside the travel path of positioning belt 24, a horizontal continuous guide panel 54 is provided. A switch 56 is pivotably mounted at a distance above guide panel 54. The free end of switch 56 points in the direction of office machine 10. Switch 56 is pivotable between a position sketched in solid lines in FIG. 1 in which its free end engages guide panel 54, and a raised position indicated by dashed lines in FIG. 1, in which a gap is left for the sheets of paper to pass between guide panel 54 and switch 56. Supporting wires 58 are stretched upward from the pivot axis of switch 56, and run in a central plane between the two runs of positioning belt 24. A plurality of support wires 58 spaced apart from one another is arranged distributed over the width left between the two positioning belts 24.

Figure 5:
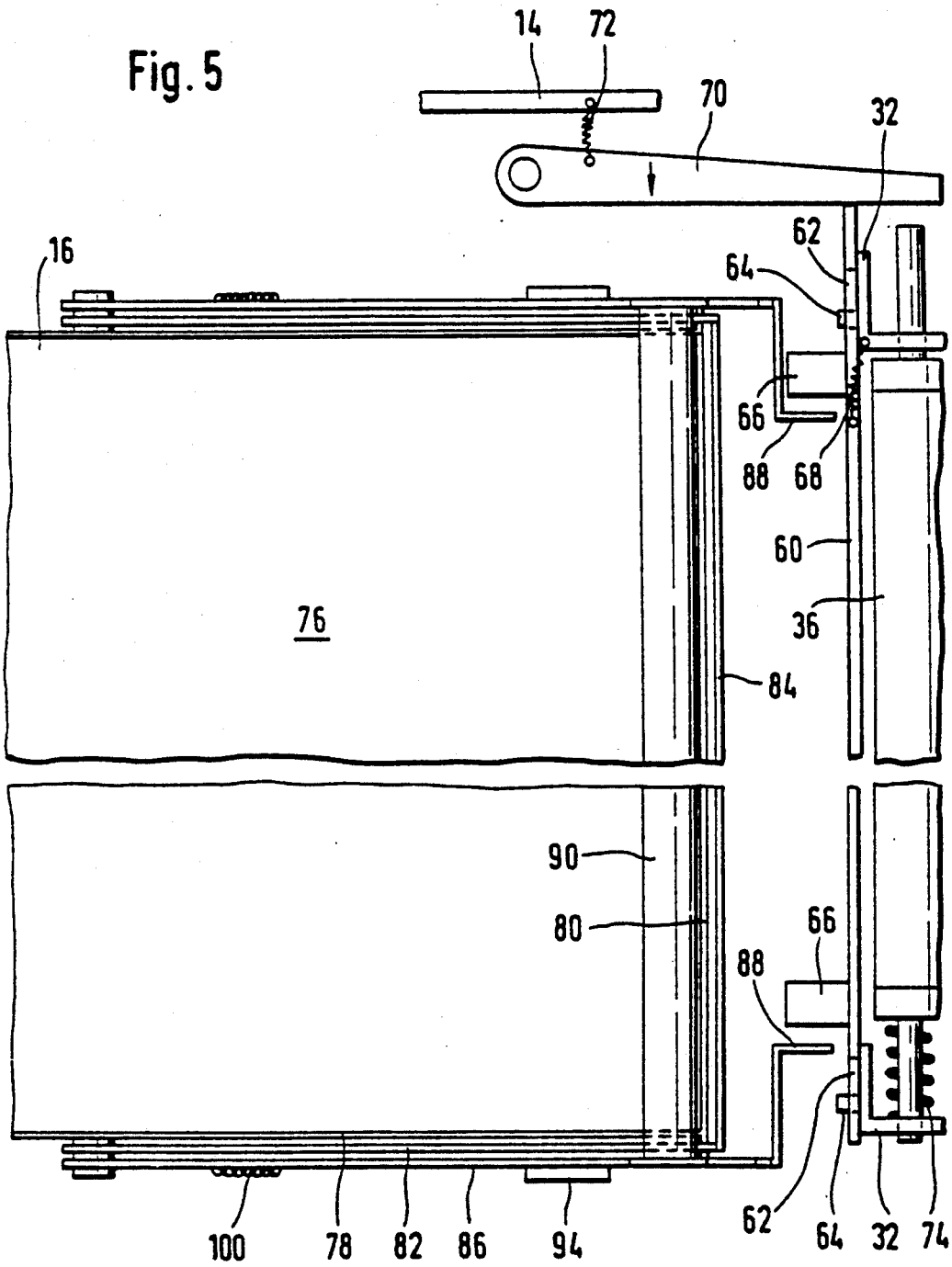
FIG. 5 is a partial section of a storage compartment and the transport unit in a top view.
Figure 6:
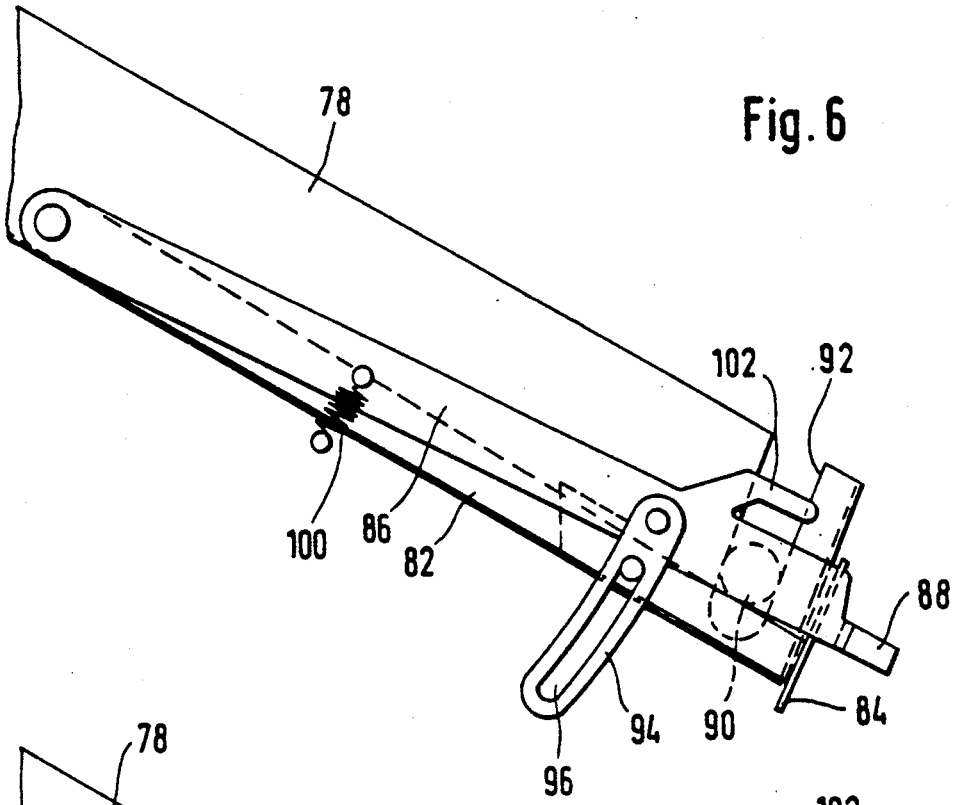
FIG. 6 is a side view of a storage compartment in the resting position.

As FIG. 5 shows transport units 32 have a pusher strip 60 on the side facing away from positioning belts 24, said strip extending over the entire width of transport unit 32 and projecting at one end laterally beyond transport unit 32. Pusher strip 60 is displaceable transversely by means of elongated holes 62 so that it can slide on pins 64 of transport unit 32. Pusher strips 60 each have two noses 66 projecting perpendicularly from transport unit 32. Pusher strip 60 is held in the position shown in FIG. 5 by a spring 68; in this position its outer end projects to the maximum extent laterally beyond transport unit 32.

On this side, between sidewall 14 and the run of positioning belt 24 which is at the left in FIG. 1 and runs in front of storage compartments 16, a control flap 70 is provided which extends vertically over the entire height of the path of transport unit 32 and is pivotable around a vertical axis. When control flap 70 is pivoted against the force of a return spring 72, it comes to rest against the projecting free end of pusher strip 60 and displaces the latter against the force of spring 68.

In another embodiment of the invention, rollers 34 and 36 are also displaceably mounted axially in transport unit 32, as is likewise shown in FIG. 5. The shafts of rollers 34 and 36 are likewise extended laterally beyond transport unit 32 so that control flap 70 can strike the shafts of rollers 34 and 36 and displace rollers 34 and 36 axially, i.e. transversely to the path of movement of transport unit 32. A compression spring 74 holds rollers 34 and 36 in the basic position in which the shafts of rollers 34 and 36 are projected the maximum extent from transport unit 32, as shown in FIG. 5. When control flap 70 pivots, it initially comes in contact with pusher strip 60 and displaces pusher strip 60. As control flap 70 pivots further, it also comes in contact with the shafts of rollers 34 and 36 and additionally displaces rollers 34 and 36. In this embodiment, gears 38 and 40 are mounted nonrotatably but axially displaceably on the shafts of rollers 34 and 36, so that these shafts can be displaced by control flap 70 without gear 40 disengaging from drive belt 42.

Storage compartments 16 have a box bottom 76 with sidewalls 78 and a front support wall 80 facing positioning belts 24 to receive the accumulated stack of paper sheets. Outside, on sidewalls 78, two legs 82 are pivotably mounted which project forward beyond support wall 80 and are connected together in front of support wall 80 by a sheet stop 84. In addition, arms 86 are pivotably mounted on the pivot point of legs 82. Arms 86 project forward beyond legs 82 and sheet stop 84 and have at their forward ends, tabs 88 bent toward one another which project opposite the path of movement of transport unit 32. In the forward area of storage compartment 16, arms 86 are connected together by a beam-shaped hold-down 90 running transversely which rests on the stack of paper stored in storage compartment 16 and compresses it. Cutouts 92 in sidewalls 78 allow the hold-down device 90 to rest on the paper stack even when the stack is low. Each of arms 86 has a downwardly directed tab 94 with an elongated hole 96. A pin 98 of leg 82 engages elongated hole 96 so that arms 86 and legs 82 are pivotable with respect to one another through an angle determined by the length of elongated hole 96. A tension spring 100 tensioned between arms 86 and sidewalls 78 pulls arms 86 downward so that hold-down 90 rests on the stack of paper stored in storage compartment 16 under the influence of this tension spring 100.

One of arms 86 has an upwardly projecting tab 102 which cooperates with a stop which limits the pivoting action of arms 86 upward.

The sorting device operates as follows:

Initially, storage compartments 16 are inserted in the desired number by means of support flaps 18 in sidewalls 14. The mutual vertical spacing of storage compartments 16 is selected to match the desired capacity. The positions of the inserted storage compartments 16 are stored in the control electronics.

Figure 4:
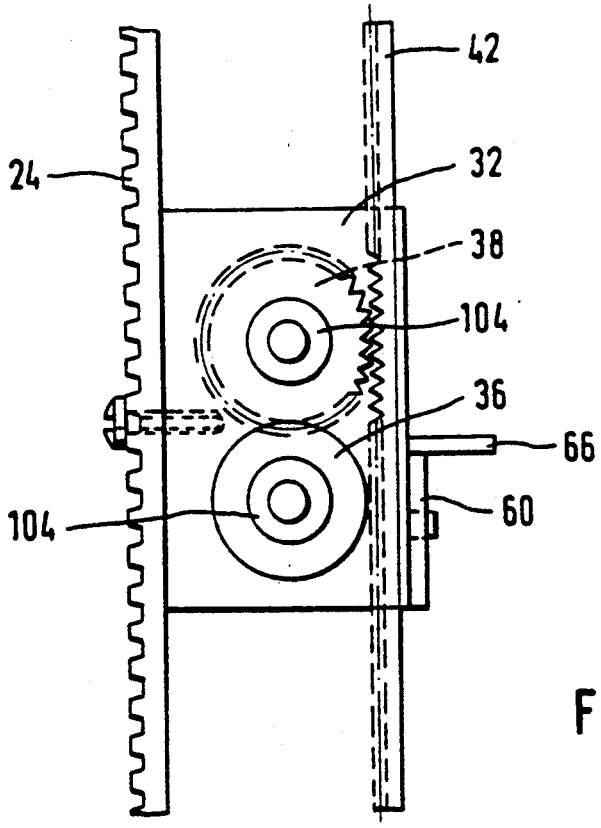
FIG. 4 shows the transport unit in the receiving position.

If a sheet of paper 12 discharged from office machine 10 is to be stored in the inverted position (face down), this sheet 12 is initially pushed by office machine 10 against sheet stop 52 against which it bends convexly, as shown in FIG. 1. Stepping motor 26 is energized to rotate clockwise, so that positioning belts 24 are driven by the engaged overrunning clutch while drive belt 42 is not driven. Transport unit 32, which is located at the right-hand run of positioning belt 24 in FIG. 1, is moved downwardly into the receiving position at sheet stop 52 shown in FIG. 1. As FIG. 4 shows, gear 38 of upper roller 34 is then engaged with drive belt 42. As the transport unit 32 moves, gear 38 is driven by fixed drive belt 42 so that it turns counterclockwise. Overrunning clutch 104 is disengaged at this time so that rollers 34 and 36 are not driven.

As soon as transport unit 32 has reached the receiving position shown in FIG. 1, sheet stop 52 is pivoted downward and sheet 12, under the pressure of its convexity, is forced so that its leading edge enters the nip between rollers 34 and 36. Now the control electronics reverses the rotational direction of stepping motor 26 so that the latter rotates counterclockwise. The drive for positioning belts 24 is then disengaged so that they stop moving. The drive of drive belt 42 is engaged so that drive belt 42 is now driven clockwise, in other words downward in FIG. 4. Overrunning clutch 104 of gear 38 then engages, roller 34 is driven, and roller 36 turns freely with it. Sheet 12 is pulled in by rollers 34 and 36 and pushed downward over the downwardly pivoted switch 56 along support wires 58 into the position shown by the dashed lines in FIG. 1.

Figure 3:
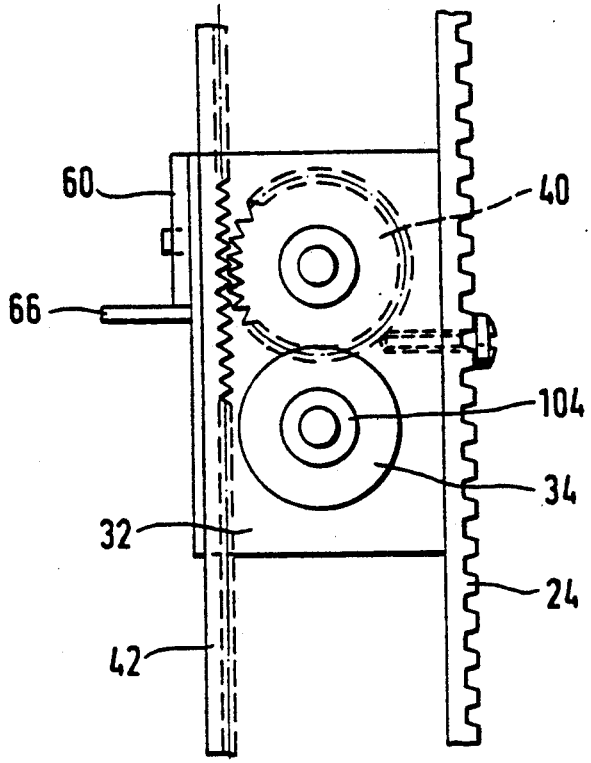
FIG. 3 shows the transport unit of the sorting device in the dispensing position.

Before the trailing edge of sheet 12 escapes from the nip of rollers 34 and 36, the direction of rotation of stepping motor 26 is reversed once more so that the motor again rotates clockwise (FIG. 1). Once again the drive of positioning belts 24 is engaged and the drive for drive belt 42 is disengaged. Transport unit 32 consequently moves clockwise around lower pulley 22 and it reaches the left-hand run of positioning belt 24. Gear 38 then initially meshes again with drive belt 42 which is at rest, and its overrunning clutch 104 is disengaged. When transport unit 32 runs around lower pulley 22, gear 38 is disengaged from drive belt 42 and gear 40 of the other roller 36 engages drive belt 42 as shown in FIG. 3. While transport unit 32 runs upward powered by positioning belt 24, gear 40 meshes with drive belt 42 which is at rest and is rotated counterclockwise. Overrunning clutch 104 then disengages so that roller 36 is not powered. Sheet 12 therefore during this movement of transport unit 32 remains gripped firmly in the nip of rollers 34 and 36 and is carried along by transport unit 32.

Figure 7:
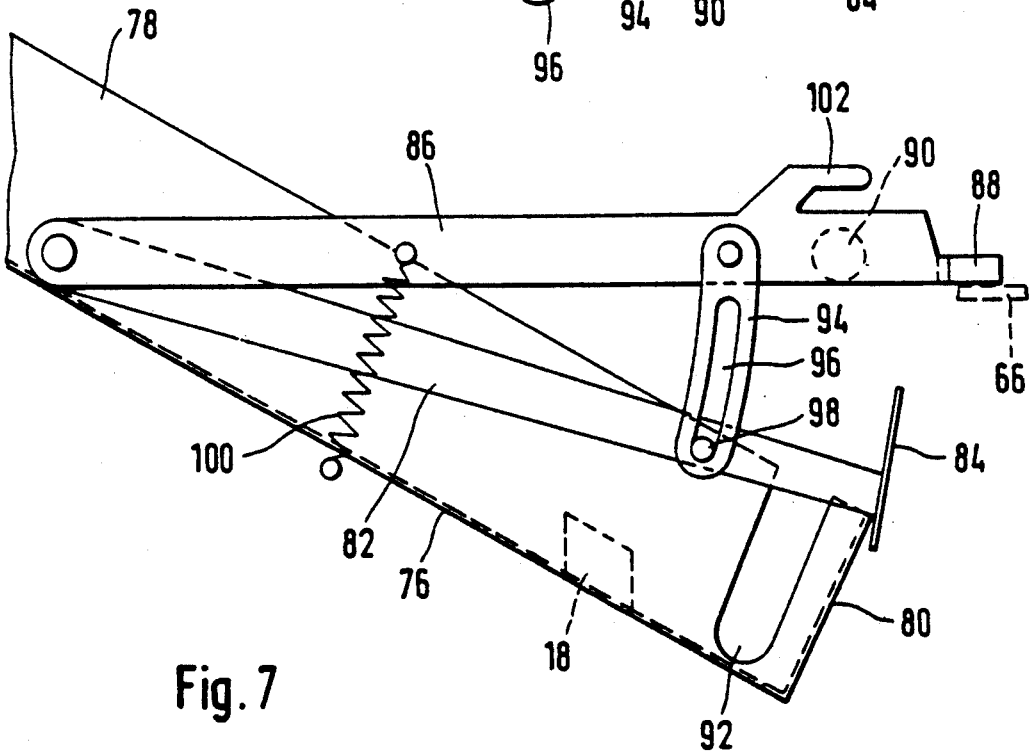
FIG. 7 is a representation corresponding to FIG. 6 of the storage compartment in the insertion position.

The electronic control monitors the drive of positioning belts 24 and actuates control flap 70 as soon as the transport unit has passed storage compartment 16 which is located immediately in front of the selected storage compartment 16. As a result of the pivoting of control flap 70, the latter comes in contact with pusher strip 60 and displaces the latter. Noses 66 of pusher strip 60, in the resting position of pusher strip 60, are in the position shown in FIG. 5 in which they can travel unimpeded over tabs 88 of storage compartments 16. As a result of displacement by means of control flap 70, noses 66 then move into the vicinity of tabs 88. Then as transport unit 32 moves past the selected storage compartment 16, noses 66 engage tabs 88 and lift arms 86 with hold-down device 90 off the paper stack stored in this storage compartment 16, as shown in FIG. 7. As a result of tab 94 moving and engaging pin 98, arms 86 also are lifted off legs 82 so that an insertion gap opens up between hold-down device 90 and the upper edge of sheet stop 84.

The lifting of arms 86 with hold-down device 90 and legs 82 creates a resistance to the movement of transport unit 32. This resistance increases the torque delivered by stepping motor 26 so that the housing of stepping motor 26 with nose 106 rotates against the force of spring 112 opposite the direction of rotation of the motor shaft, in other words counterclockwise. Nose 106 thereby actuates the first switching element 108 so that the control electronics is informed that transport device 32 has reached the selected delivery position. The direction of rotation of stepping motor 26 is then reversed once again so that positioning belts 24 are no longer powered. The pawl prevents positioning belts 24 from being moved backward by the pressure of hold-down device 90 resting on noses 66 of transport unit 32. Drive belt 42 is then driven clockwise. Drive belt 42 then runs upward in FIG. 3 and rotates gear 40 of roller 36 clockwise so that its overrunning clutch 104 is engaged and roller 36 is driven. Roller 34 then rotates freely. Sheet 12 is then fed by rollers 34 and 36 through the insertion slot between hold-down device 90 and sheet stop 84, into storage compartment 16.

If the paper stack stored in storage compartment 16 has grown to the point where it is higher than forward support wall 80, the stored paper sheets have their leading edges abutting the upwardly pivoted sheet stop 84 so that a higher stack can be reliably held in storage compartment 16. The friction between the leading edge of the paper stack and sheet stop 84 prevents sheet stop 84 from falling downward as hold-down device is lowered.

When the stored paper stack has grown to the point where no more sheets can be accepted, when arms 86 are raised by noses 66, the 102 strikes the stop. This blocks transport unit 32 so that the torque delivered by stepping motor 26 abruptly rises sharply. The housing of stepping motor 26 consequently rotates against the force of spring 112 until nose 106 actuates second switching element 110. This generates a "full" signal which can be displayed optically for example.

As soon as the sheet has been completely dispensed into storage compartment 16, control flap 70 is released again and returned by return spring 72. Pusher strip 60 is reset by spring 68 so that noses 66 release tabs 88 again. Hold-down device 90 is pulled onto the paper stack stored in storage compartment 16 under the action of tension spring 100.

This terminates the storage process and positioning belts 24 are driven again to move the other transport unit 32 into the receiving position. Since the two transport units 32 are arranged diametrally opposite one another, only one trip with a maximum length equal to the length of the right-hand run of positioning belt 24 is required to bring transport unit 32 into the receiving position. The sorting device is therefore very quickly prepared once more to take the next sheet of paper 12 from office machine 10.

When rollers 34 and 36 of one transport unit 32 are driven in the receiving position, the other transport unit 32 has already dispensed its sheet of paper so that driving rollers 34 and 36 of this other transport device 32 does not create any problems.

It is readily apparent that instead of the single drive belt 42 shown, separate drive belts can be provided to run on the right and left (in FIG. 1). The two drive belts in this case will likewise be driven by a common stepping motor 26.

If control flap 70 continues pivoting as a result of actuation of pusher strip 60 when the individual sheets are stored, it also displaces rollers 34 and 36 with the sheet of paper gripped in the nip of the rollers. The sheet of paper is thereby shifted sideways and placed in storage compartment 16. In this way it is possible, by controlled pivoting of control flap 70 into its first or second pivot position, to store the sheets of paper in storage compartment 16 optionally with or without lateral displacement (offset) in order thereby to permit simpler separation of the paper stack.

If sheets 12 dispensed by office machine 10 are to be stored in the position in which they were dispensed by the office machine (face up), switch 56 is pivoted upward into the position shown by the dashed lines in FIG. 1. Transport unit 32 is moved into a receiving position which is located at the left-hand run of positioning belt 24 in FIG. 1 adjacent to guide panel 54. Sheet 12 dispensed by office machine 10 slides with its leading edge over guide panel 54 and reaches the roller nip of transport unit 32. Drive belt 42 is then powered so that, as described above, gear 40 is powered and drives roller 36 through its engaged overrunning clutch 104. The drive is provided for such a short time that only the leading edge of sheet 12 is pulled in. Then transport unit 32 is conveyed in the manner described above to the selected storage compartment 16, taking sheet 12 with it. The sheet is dispensed into storage compartment 16 as described above.

It is clearly evident that the sorting device can also be designed with horizontally running positioning belts 24 and drive belts 42, in which case storage compartments 16 are located essentially perpendicularly below the lower horizontal run of positioning belt 24.

In one embodiment of this kind, the sheets released by transport unit 32 fall freely downward into the storage compartments. A forward support panel and a sheet stop on the side of the storage compartments facing transport unit 32 is not required. In order to hold the individual sheets tightly together in a stack, the stack rests for example on a conveyor belt which is actuated after a sheet is inserted and guides the lower edge of the sheet resting on the conveyor belt against the stack held by a stop rail. The conveyor belt slides through beneath the vertical stack. In the upper area, the stack is held together by a spring-loaded hold-down device. In this embodiment the stack is removed laterally from the storage compartments.

I claim:

1. A sorting device for storing sheet-form recording media comprising:

a plurality of storage compartments in parallel array and each having an insertion side for receiving recording media;

means comprising a transport unit having a pair of driven rollers for selectively seizing and discharging a recording medium; and means for moving said transport unit between first and second selected positions comprising a motor, an endless positioning belt, said endless positioning belt having a first run extending along the insertion sides of said storage compartments, and a second run spaced from said first run, means comprising said motor for driving said endless positioning belt, and means for attaching said transport unit to said endless positioning belt; said first position being on the first run of said endless belt adjacent the insertion side of a selected storage compartment, and said second position being a receiving position on the second run of said endless belt.

2. The sorting device according to claim 1, and a second transport unit on said endless positioning belt spaced from said first transfer unit one half the length of said belt.

3. A sorting device for storing sheet-form recording media comprising:

a plurality of storage compartments in parallel array and each having an insertion side for receiving recording media;

means comprising a transport unit having a pair of driven rollers for selectively seizing and discharging a recording medium;

means for moving said transport unit between a discharging position adjacent the insertion side of a selected storage compartment, and a receiving position for receiving media comprising a motor, a positioning element extending along the insertion sides of said storage compartments, means comprising said motor for driving said positioning element, and means for attaching said transport unit to said positioning element;

means including said motor for driving said rollers of said transport unit;

means for changing the direction of said motor;

means for driving said driven rollers when said motor is rotating in a first direction; and means for driving said positioning element when said motor is rotating in a second direction.

4. The sorting device according to claim 3, wherein said means for driving said driven rollers comprises gears on said driven rollers, means comprising overrunning clutches for connecting said gears with said driven rollers for moving recording media held by said driven rollers toward said storage compartment.

5. The sorting device according to claim 3, wherein said means for driving said rollers comprises a roller drive belt having first and second runs parallel to the first and second runs of said endless positioning belt, said means for driving said roller drive belt comprising means for driving said roller drive belt in the same direction as the endless positioning belt, said roller drive belt engaging a said gear of a said driven roller when said transfer unit is adjacent a said storage compartment, said roller drive belt at said second, opposite run of said endless positioning belt engaging a gear on the opposite roller of said second transfer unit.

6. The sorting device according to claim 5, each of said driven rollers of each of said transport units having two gears spaced axially with respect to one another, said roller drive belt engaging an outer gear of one said roller and an inner gear of the other said roller of a said transport unit.

7. The sorting device according to claim 6, said roller drive belt being an endless belt, and means for supporting said roller drive belt in a path outwardly of the path of said positioning belt.

8. A sorting device for storing sheet-form recording media having edges comprising:

a plurality of storage compartments each having an insertion side for receiving recording media;

means comprising a transport unit having a pair of driven rollers for selectively seizing and discharging a recording medium;

means for moving said transport unit between first and second selected positions comprising a motor, a positioning element extending along the insertion sides of said storage compartments, means comprising said motor for driving said positioning element, and means for attaching said transport unit to said positioning element, said first position being a discharging position adjacent the insertion side of a selected storage compartment, and said second position being at a receiving position for media;

means for supporting said storage compartments inclined to the horizontal and in parallel array comprising a plurality of means for slidably receiving and supporting a said storage compartment thereon, for placement of a storage compartment independently of the placement and the position of each other storage compartment, said storage compartments each comprising:

a bottom having a lower part, a supporting wall at the lower part thereof for supporting the edge of a stack of stored recording media, and means comprising a movable sheet stop for supporting media at a height above the top of said supporting wall in a raised position of said sheet stop.

9. The sorting device according to claim 8, and means for pivotally supporting said sheet stop on said storage compartment, and means for raising said sheet stop comprising said holding down means after said holding down means has been raised a predetermined angular amount.

10. A sorting device for storing sheet-form recording media comprising:

a plurality of storage compartments in parallel array and each having an insertion side for receiving recording media;

means comprising a transport unit having a pair of driven rollers for selectively seizing and discharging a recording medium;

means for moving said transport unit between first and second selected positions comprising a motor, a positioning element extending along the insertion sides of said storage compartments, means comprising said motor for driving said positioning element, and means for attaching said transport unit to said positioning element, said first position being a discharging position adjacent the insertion side of a selected storage compartment, and said second position being at a receiving position for media; and said transport unit having at least one nose projecting towards said storage compartments, said storage compartments each having pivotally mounted means for holding down recording media in a storage compartment, and means for urging said holding down means against media in said storage compartment, means for lifting said holding down means off the media in each said storage compartment comprising at least one tab projecting from said storage compartment towards said transport unit, means mounting at least one of said nose of said transport unit and said tab of said storage compartment for relative movement from a position in which said tab of said holding down means is located laterally of the path of movement of said nose into an engagement position in which tab of said storage compartment projects into the path of movement of said nose, whereby when in said engagement position, said nose during the movement of said transport unit lifts said holding down means off the media in said storage compartment by engaging said tab of said holding down means.

11. The sorting device according to claim 10, and further comprising mounting means for said nose comprising a pusher strip mounted for transverse displacement on said transport unit and projecting laterally thereof, and pivotally mounted control flap means for striking said pusher strip for moving said pusher strip and said nose into the engagement position.

12. The sorting device according to claim 11, and further comprising means for mounting said driven rollers of said transport units for displacement transversely of their axes, said driven rollers each having a shaft projecting laterally beyond said transport unit, said control flap comprising means for striking said pusher strip in a first position thereof and for striking said shaft of said driven roller to displace both said driven rollers transversely of their axes in a second position of said control flap.

13. The sorting device according to claim 10 or claim 11, and means for sensing increase in the torque of said motor when driving said positioning element when said transport unit lifts said holding down means, and means responsive to said sensing means for positioning said transport unit in said discharging position.

14. The sorting device according to claim 13, and means for generating a "full" signal to indicate that said storage compartment having the holding down means thereof lifted is full comprising a stop engaged by said holding down means when it is raised by said transport unit and said compartment is full.

15. The sorting device according to claim 14, wherein said means for generating said "full" signal further comprises means for sensing increase in the torque of said motor when positioning said transport unit at said storage compartment and by said holding down means engaging said stop.

16. The sorting device according to claim 15, said motor having a housing, said means for generating said "full" signal further comprising means for mounting said motor housing for rotation opposite to the direction of rotation of the drive of said positioning element, and spring means for resisting said movement of said motor housing, switching means responsive to movement of said motor housing for generating said "full" signal; and said means for sensing increase in the torque of said motor when driving said positioning element when said transport unit lifts said holding down means comprising second switching means responsive to movement of said motor housing prior to the sensing of housing movement by said first mentioned switching means.

17. The sorting device according to claim 13, wherein said motor has a housing, and further comprising means for causing a further increase in the torque of said motor when positioning said transport unit at said storage compartment by said holding down means engaging said stop, said means for causing said further increase in the torque of said motor comprising means for mounting said motor housing for rotation opposite to the direction of rotation of the drive of said positioning element, spring means for resisting said movement of said motor housing, and switching means responsive to movement of said motor housing for positioning said transport unit in the dispensing position upon the sensing of a first torque resulting from the raising of said holding down means by said transport unit, and from a second and greater torque resulting from said holding down means engaging a stop when said storage compartment is full.

18. A sorting device for storing sheet-form recording media comprising:

a plurality of storage compartments in parallel array and each having an insertion side for receiving recording media;

means comprising a transport unit having a pair of driven rollers for selectively seizing and discharging a recording medium;

means for moving said transport unit between first and second selected positions comprising a motor, a positioning element extending along the insertion sides of said storage compartments, means comprising said motor for driving said positioning element, and means for attaching said transport unit to said positioning element, said first position being a discharging position adjacent the insertion side of a selected storage compartment, and said second position being a receiving position for media; and means for mounting said driven rollers of said transport unit for displacement transversely of their axes and for selective support of said driven rollers in said mounting means in a plurality of axially transverse positions.

19. The sorting device according to claim 18, wherein said driven rollers each has a shaft projecting laterally beyond said transport unit, and means comprising a control flap for striking said projecting shaft for effecting transverse displacement of said driven rollers.

20. The sorting device according to claim 19, said control flap comprising means for displacing said rollers.

21. A sorting device for storing sheet-form recording media comprising:

a plurality of storage compartments in parallel array and each having an insertion side for receiving recording media;

means comprising a transport unit having a pair of driven rollers for selectively seizing and discharging a recording medium; and means for moving said transport unit between first and second selected positions comprising a motor, an endless positioning belt, said endless positioning belt having a first run extending along the insertion sides of said storage compartments, and a second run spaced from said first run, means comprising said motor for driving said endless positioning belt in one direction only, and means for attaching said transport unit to said endless positioning belt; said first position being adjacent the insertion side of a selected storage compartment, and said second position being a receiving position on the second run of said endless belt.

22. A method of sorting and storing sheet-form recording media comprising:

(a) providing a plurality of storage compartments with insertion sides in parallel array;

(b) providing a transport unit and an endless belt for carrying said transport unit;

(c) delivering media to the transport unit at a delivery position;

(d) moving the transport unit to position the media held thereby at a selected storage compartment;

(e) discharging the media held by the transport unit into the storage compartment; and (f) moving the transport unit repeatedly from the media delivery position to a selected storage compartment and thence to the delivery position without reversing the direction of movement of said endless belt and said transport unit from one moving step to the next moving step.

23. A sorting device for storing sheet-form recording media in either face up position or face down position comprising:

a plurality of storage compartments in parallel array and each having an insertion side for receiving recording medium;

means comprising a transport unit having a pair of driven rollers for selectively seizing and discharging a recording medium;

an endless positioning belt having a first run and a second run;

means for attaching said transport unit to said endless positioning belt;

means for positioning said transport unit at a receiving position on said first run for seizing a recording medium delivered thereto;

means for positioning said transport unit at a receiving position on said second run for seizing a recording medium delivered thereto;

means for selectively delivering a recording medium to said transport unit when said transport unit is at said receiving position on said first run, and when said transport unit is at said receiving position on said second run;

means for moving said transport unit from each of said receiving positions to a delivery position on a said run adjacent the insertion side of a selected storage compartment; and means for causing said driven rollers of said transport unit to discharge a recording medium held thereby into a selected storage compartment.

24. A sorting device for storing sheet-form recording media in either face up position or face down position comprising:

a plurality of storage compartments in parallel array and each having an insertion side for receiving recording medium;

means comprising a transport unit having a pair of driven rollers for selectively seizing and discharging a recording medium;

means for positioning said transport unit at a first receiving position for seizing a recording medium delivered thereto;

means for positioning said transport unit at a second receiving position for seizing a recording medium delivered thereto;

means for selectively delivering a recording medium to said transport unit when said transport unit is at said first receiving position, and when said transport unit is at said second receiving position;

means for moving said transport unit from each of said receiving positions to a delivery position adjacent the insertion side of a selected storage compartment comprising means for causing inversion of said transport unit only when it is moved from one said receiving position; and means for causing said driven rollers of said transport unit to discharge a recording medium held thereby into a selected storage compartment.

* * * * *